US011525454B2

(12) United States Patent
Liu et al.

(10) Patent No.: US 11,525,454 B2
(45) Date of Patent: Dec. 13, 2022

(54) SEMI-OPEN CENTRIFUGAL PUMP IMPELLER AND ITS OPTIMIZATION DESIGN

(71) Applicant: Jiangsu University, Jiangsu (CN)

(72) Inventors: Houlin Liu, Jiangsu (CN); Kaikai Luo, Jiangsu (CN); Zilong Zhang, Jiangsu (CN); Yong Wang, Jiangsu (CN); Kai Wang, Jiangsu (CN); Liang Dong, Jiangsu (CN); Minggao Tan, Jiangsu (CN)

(73) Assignee: Jiangsu University, Jiangsu (CN)

( * ) Notice: Subject to any disclaimer, the term of this patent is extended or adjusted under 35 U.S.C. 154(b) by 456 days.

(21) Appl. No.: 16/669,276

(22) Filed: Oct. 30, 2019

(65) Prior Publication Data

US 2020/0088208 A1 Mar. 19, 2020

Related U.S. Application Data

(63) Continuation of application No. PCT/CN2018/094736, filed on Jul. 6, 2018.

(51) Int. Cl.

| | |
|---|---|
| ***F04D 29/30*** | (2006.01) |
| ***F04D 29/24*** | (2006.01) |
| *F04D 7/04* | (2006.01) |
| *F04D 29/22* | (2006.01) |

(52) U.S. Cl.

CPC ..... *F04D 29/242* (2013.01); *F04D 29/30* (2013.01); *F04D 7/04* (2013.01); *F04D 29/2216* (2013.01); *F04D 29/2288* (2013.01); *F05D 2240/303* (2013.01)

(58) Field of Classification Search

CPC ..... F04D 29/242; F04D 29/30; F04D 29/2216

See application file for complete search history.

(56) References Cited

U.S. PATENT DOCUMENTS

2019/0249560 A1* 8/2019 Kuhns ..... F04D 25/045

FOREIGN PATENT DOCUMENTS

| | | | |
|---|---|---|---|
| CN | 2072611 | U | 3/1991 |
| CN | 2426027 | Y | 1/2001 |
| CN | 203892243 | U | 10/2014 |
| CN | 204152837 | U | 2/2015 |

(Continued)

*Primary Examiner* — Sabbir Hasan

(74) *Attorney, Agent, or Firm* — Miller Law Group, PLLC

(57) ABSTRACT

A process for optimizing the design of a semi-open centrifugal pump impeller involves the steps of, reducing the number of long blades and adding a medium length splitter blade and a short length splitter blade having varying circumferential distances between any two optimized long blades. Each medium length and short length splitter blade have the same outlet position, profile and thickness as the optimized long blade; however, the medium length and short length splitter blades have different inlet positions relative to the optimized long blade. The long blade, medium length splitter blade and short length splitter blade are arranged in circumferential sequence along the direction of rotation of the impeller. This optimization improves various problems arising from the original semi-open centrifugal pumps, including low efficiency, significant loss at the inlet, inlet cavitation, separation of boundary layers at the blade inlets, narrow lift range of the dead point and excessive noise.

19 Claims, 4 Drawing Sheets

(56) References Cited

FOREIGN PATENT DOCUMENTS

| | | | |
|---|---|---|---|
| CN | 204419687 | U | 6/2015 |
| CN | 207278564 | U | 4/2018 |
| SU | 1528964 | A1 | 12/1989 |

* cited by examiner

SEMI-OPEN CENTRIFUGAL PUMP IMPELLER AND ITS OPTIMIZATION DESIGN

CROSS REFERENCE TO RELATED APPLICATIONS

This application is a continuation of PCT Patent Application No. PCT/CN2018/094736, filed on Jul. 6, 2018, and claiming priority on Chinese Patent Application No. 201810587225.X filed on Jun. 6, 2018, the contents of which are incorporated herein by reference.

FIELD OF THE INVENTION

The present invention involves research into centrifugal pumps, and more particularly, a semi-open centrifugal pump impeller having an optimization design.

BACKGROUND OF THE INVENTION

A centrifugal pump is viewed as a generic type of machinery, the primary function of which is to convert original mechanical energy into the energy carried by fluid. Centrifugal pumps are known in a wide variety and have been utilized in highly widespread applications in all aspects of industry, including various hi-tech industries such as aerospace. As reveal by statistics, the energy consumption by pumps accounts for 18% of the overall energy output in China. Therefore, raising the level of research and design for centrifugal pumps is of considerable significance to the growth of the national economy, energy conservation and environmental preservation. Regarding the semi-open centrifugal pumps, apart from efficiency, consideration shall also be given to the lift range of the dead point.

In Chinese Patent No. 204419687, entitled "A sort of Splitter Blade Used on Centrifugal Pumps" which discloses splitter blades that features an alternate arrangement of long and short blades in design. Similarly, Chinese Patent No. 2072611, entitled "The Offset of Low Specific Speed Short Blade Used on Centrifugal Pump" discloses splitter blades that features the offset of short blades in long blades.

The instant invention differs from the known prior art references in the number of splitter blades and the selection of parameters. As will be described below, the instant invention provides an optimization design that covers the medium and long length blades arranged in between long length blades on the impeller, the blade angle at the inlet and outlet of blades on the impeller, the fillet of the pressure surface on blade outlet, the blade thickness, the hub fillet at the inlet of the impeller and the distance of impeller arrangement. This sort of optimization is capable of enhancing the performance of the original semi-open centrifugal pump, improving efficiency and lift range of the dead point, and reducing cavitation.

Accordingly, it would be desirable to provide a design that features an addition of splitter blades with medium or short length. With the outer diameter of the blades and the cross section area of the shaft kept unchanged, the lift range of the dead point can be increased and the pump efficiency can be improved in such designs by optimizing the inlet and outlet of blades, the thickness of blades and the hub at the blade inlet.

SUMMARY OF THE INVENTION

The object of the present invention is to provide an optimized design for an impeller on a semi-open centrifugal pump.

It is a feature of this invention that the impeller covers medium and long length blades arranged in between long length blades on the impeller.

It is another feature of this invention that the blade angle at the inlet and outlet of blades on the impeller, the fillet of the pressure surface on blade outlet, the blade thickness, the hub fillet at the inlet of the impeller and the distance of impeller arrangement are optimized for maximum efficiency.

It is an advantage of this invention that the design optimization enhances the performance of the original semi-open centrifugal pump, improves operating efficiency and improves the lift range of the dead point, thus reducing cavitation.

To overcome the disadvantages of the known prior art devices, a semi-open centrifugal pump impeller along with its optimization design is proposed, which helps cope with various problems arising from the original semi-open centrifugal pumps, such as low efficiency, significant loss at the inlet, inlet cavitation, leak at the front cover, separation of boundary layers at the blade inlets, narrow lift range of the dead point and excessive noise.

The objects features and advantages set above are achieved by optimizing the design of the semi-open centrifugal pump impeller. The impeller has a number ($Z_1$) of long blades fitted on the impeller before optimization. The blade angle for the outlet side on the pressure surface of the long blades before the optimization is set as $\alpha_{Z1}$, the blade angle for the outlet side on the suction surface of the long blades before the optimization is set as $\alpha_{b1}$, the thickness of circumferential blades on the inlet side of the long blades before the optimization is set as $d_{j1}$, the thickness of circumferential blades on the outlet of the long blades before the optimization is set as $d_{c1}$. The number of long blades after optimization is lower than the number of long blades before optimization. The medium and short length splitter blades are arranged with varying circumferential distances in between any two optimized long blades as mentioned above. The medium and short length splitter blades as mentioned above have the same outlet position, profile and thickness as the optimized long blades. The medium and short length splitter blades as mentioned above have different inlet position to the optimized long blades. The above-mentioned optimized long blades as well as the short and medium length splitter blades are arranged in circumferential sequence along the direction of impeller spinning.

Furthermore, the above-mentioned optimized long blades as well as the medium and short length splitter blades have the same epiphyseal line as the long blades before optimization.

Moreover, the blade angle for the outlet side on the front end of optimized long blades $\alpha_{Z2}=K_2\alpha_{Z1}$, where, $K_2$ represents the correction coefficient and $K_2=1\sim1.2$.

The blade angle for the outlet side on the suction surface of optimized long blades $\alpha_{b2}=K_3\alpha_{b1}$, where $K_3$ represents the correction coefficient and $K_3=0.8\sim1$.

The thickness of circumferential blades on the inlet side of optimized long blades is $d_{j2}=K_4d_{j1}$, where, $K_4$ represents the correction coefficient and $K_4=0.5\sim0.8$.

The thickness of circumferential blades on the inlet side of optimized long blades is $d_{c2}=K_5d_{c1}$, where $K_5$ represents the correction coefficient and $K_5=1.2\sim2$.

Furthermore, the number of optimized long blades $Z_2=K_1Z_1$, which is calculated and then rounded. In this equation, $K_1$ denotes the correction coefficient and $K_1$=0.4~0.6. The number of medium length splitter blades is $Z_3$. The number of short splitter blades is $Z_4$ and identical to that of long blades, $Z_2$.

The diameter of inlet side on the medium length splitter blades is $$d_2 = \frac{3d_4 + 2d_1}{3},$$

and the diameter of inlet side on the short splitter blades is $$d_3 = \frac{2d_4 + 3d_1}{3},$$

where $d_4$ represents the outer diameter of the impeller, and $d_1$ denotes the diameter of inlet side on the optimized long blades.

The dip angle ($\beta_2$) of inlet side on the medium-length splitter blades, the dip angle ($\beta_3$) of inlet side on the short splitter blades and the dip angle ($\beta_1$) of inlet side on the optimized long blades shall conform to the following relationship, which is $\beta_1=\beta_2=\beta_3$.

Furthermore, the circumferential spacing angle ($\theta_3$) of the medium-length splitter blades and that ($\theta_1$) of the short splitter blades shall conform to the following relationships:

$$\theta_1 = \frac{60(\cos\alpha_{z2} + \cos\alpha_{b2})}{Z_2\cos\alpha_{z2}}; \text{ and}$$

$$\theta_2 = \frac{120(\cos\alpha_{z2} + \cos\alpha_{b2})}{Z_2\cos\alpha_{z2}},$$

where $Z_2$ denotes the number of optimized long blades, $\alpha_{Z2}$ represents the blade angle of outlet side on the pressure surface of the optimized long blades, and $\alpha_{b2}$ indicates the blade angle of outlet side on the suction surface of the optimized long blades.

Furthermore, the hub of inlet side on the impeller is chamfered. The fillet radius ($R_1$), the inner diameter (d) of hub and the diameter ($d_5$) of hub for the inlet side on the impeller shall conform to the relationship $R_1=K_6(d_5-d)$, where $K_6$ is the correction coefficient and $K_6$=0.05~0.25.

Furthermore, the pressure surface of outlet side on the blades is chamfered. Its fillet radius ($R_2$) and the thickness ($d_2$) of circumferential blades on the outlet side of blades shall conform to the relationship $R_2=K_7d_{c2}$, where $K_7$ is the correction coefficient and $K_7$=0.2~0.4.

As for the proposed semi-open centrifugal pump impeller, it involves the optimized long blades as well as the short and medium length splitter blades. The medium and short length splitter blades are arranged with varying circumferential distances in between any two optimized long blades as mentioned above. The medium and short length splitter blades as mentioned above have the same outlet position, profile and thickness as the optimized long blades. The medium and short length splitter blades as mentioned above have different inlet position to the optimized long blades. The above-mentioned optimized long blades as well as the short and medium length splitter blades are arranged in circumferential sequence along the direction of impeller spinning.

DETAILED DESCRIPTION OF THE PREFERRED EMBODIMENT

Figure 1:
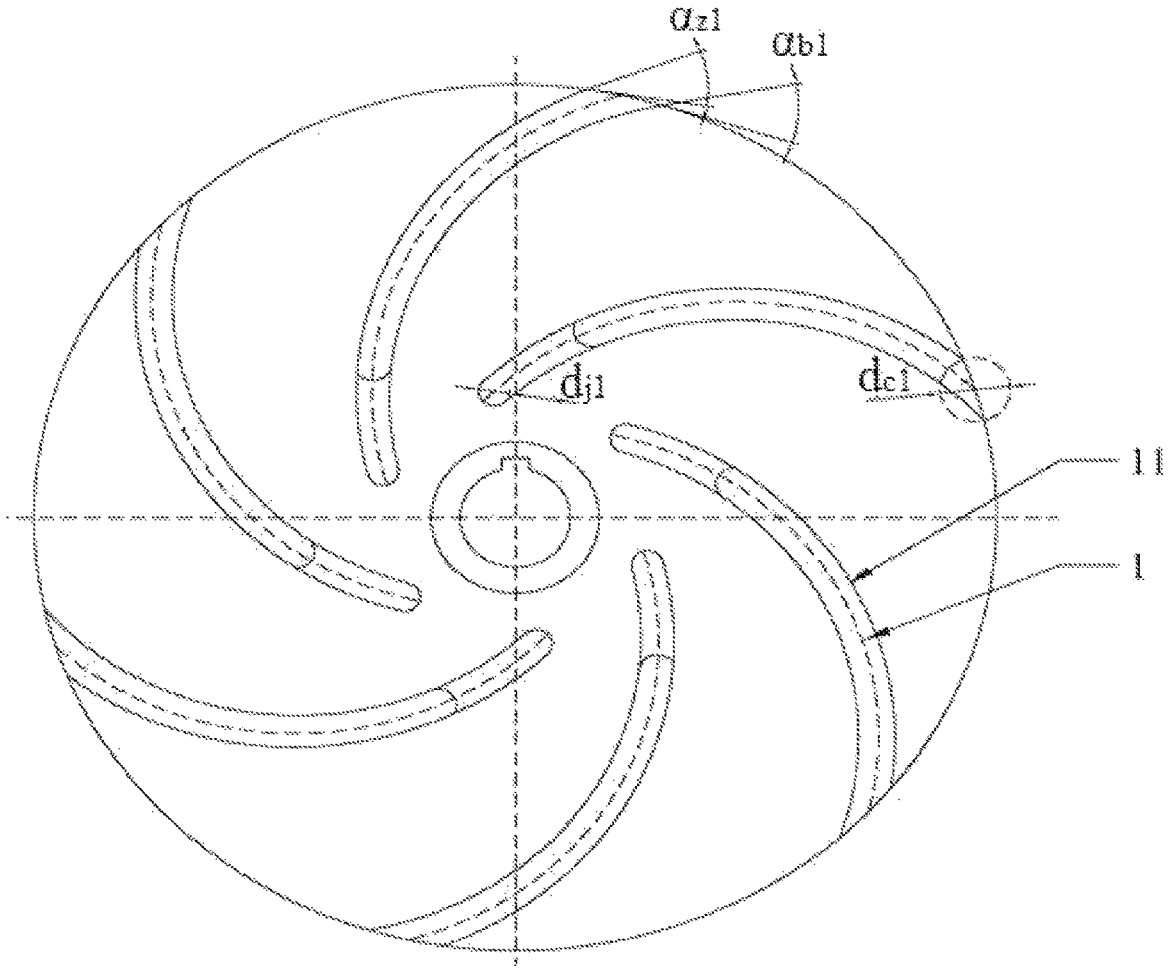
FIG. 1 is the vertical plane of the impeller shaft prior to the optimization.

The specific implementation processes of the present invention are further illustrated below in conjunction with the accompanying drawings and specific embodiments. Based on the attached schematic diagrams and the real case, the invention will be further elaborated, to which the protection of it is not limited though. In the drawings: 1—epiphyseal line; 2—optimized long blades; 3—medium length splitter blades; 4—short splitter blades; 8—outlet side; 9—pressure surface of blades; 10—suction surface of blades; 11—long impeller blades before optimization.

As shown in FIG. 1, the object of optimization is A1-typed semi-open centrifugal pump impeller, the rated rotating speed of which is 2900 times per minute. The relevant parameters of the long blades before optimization are as follows. The number of blades $Z_1$=6, the outer diameter of blades $d_4$=200 mm, the diameter of blades at the inlet side $d_1$=85.2 mm, the dip angle of blades at the inlet side $\beta_1$=130°. The blade angle ($\alpha_{Z1}$) of blade for outlet 8 at the pressure surface 9 of blade 2 is identical to that ($\alpha_{b1}$) for outlet side 8 at the suction surface 10 of blade 2 and $\alpha_{Z1}=\alpha_{b1}$=29°. The thickness of circumferential blades at blade inlets $d_{j1}$=6.5 mm, the thickness of circumferential blades at blade outlets $d_{c1}$=14.6 mm, the inner diameter of the hub d=23 mm, and the diameter of the hub at blade inlets $d_5$=35 mm.

Figures 2, 2B:
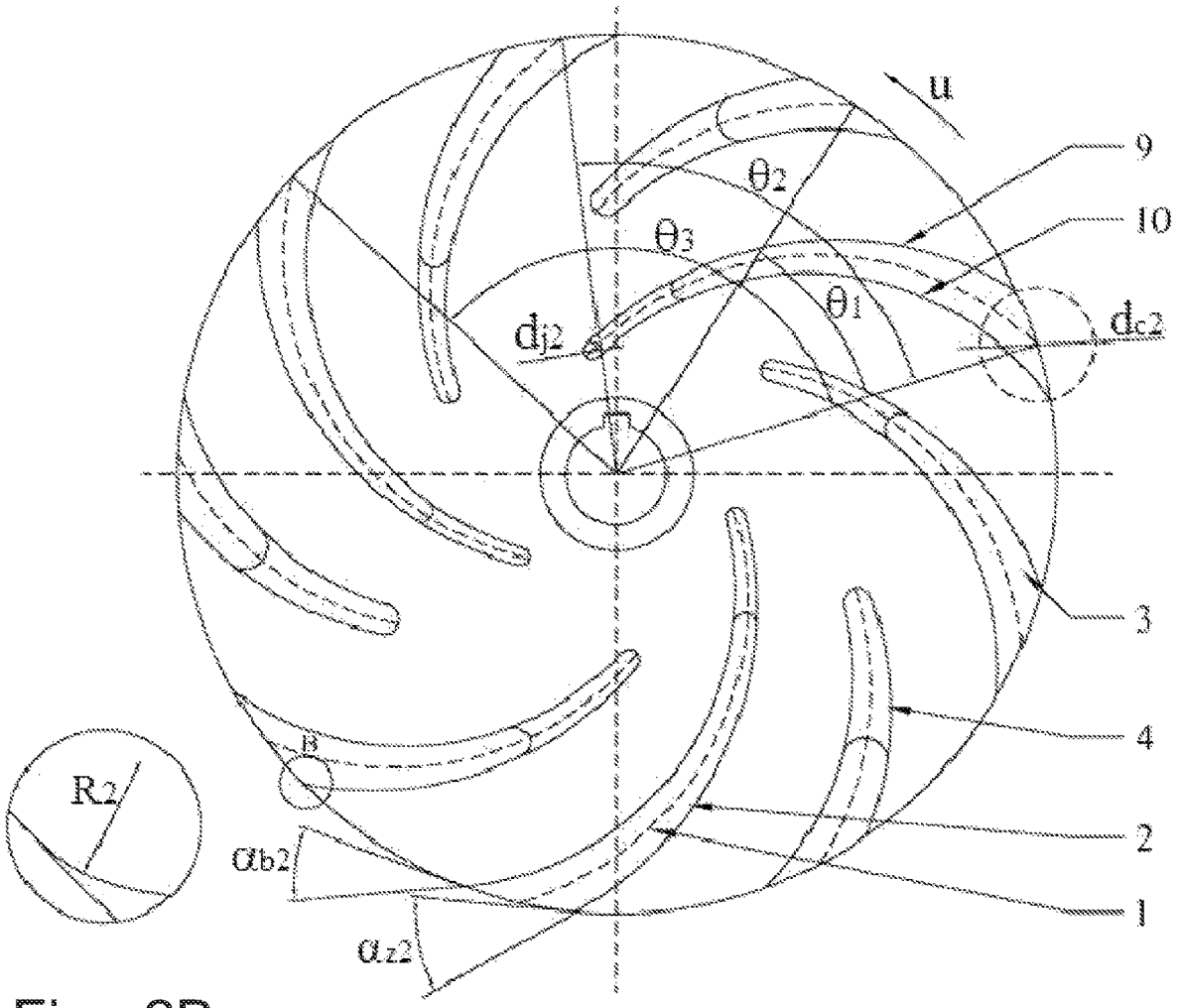
FIG. 2 is the vertical plane of the impeller shaft following the optimization and shows the enlarged image of the pressure surface of outlet blades.
FIG. 2B is an enlargement corresponding to circle B in FIG. 2.
Figure 3:
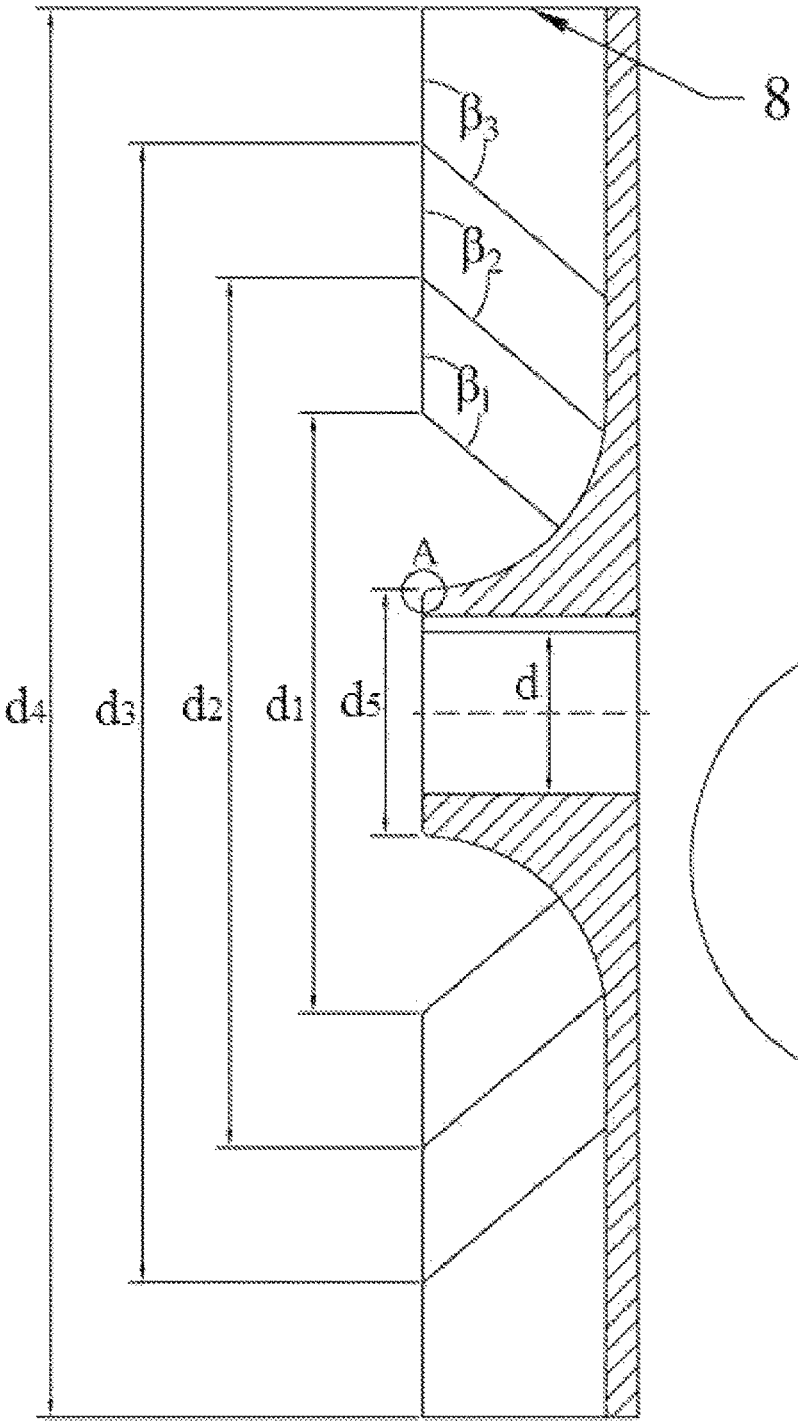
FIG. 3 is the vertical plane of the axial surface following the optimization and shows the enlarged image of the hub at the inlet side.
Figure 3A:
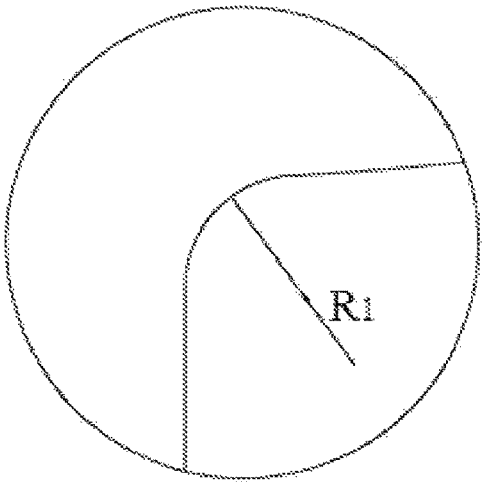
FIG. 3A is an enlargement corresponding to circle A in FIG. 3.

As shown in FIGS. 2 and 3, the optimization is detailed as follows. The number of optimized long blades 2 is lower than that of long blades 11 before optimization. The medium length splitter blade 3 and short splitter blade 4 are arranged with varying circumferential distances in between any two optimized long blades as mentioned above. The medium length splitter blade 3 and short splitter blade 4 as mentioned above have the same outlet position, profile and thickness as the optimized long blade 2. The medium length splitter blade 3 and short splitter blade 4 as mentioned above have different inlet position to the optimized long blades. The above-mentioned optimized long blade 2 as well as the medium length splitter blade 3 and short splitter blade 4 are arranged in circumferential sequence along the direction of impeller spinning. The above-mentioned optimized long blade 2 as well as the medium length splitter blade 3 and short splitter blade 4 have the same epiphyseal line 1 as the long blade 11 before optimization.

The blade angle for outlet 8 at the pressure surface 9 of the optimized blade 2 $\alpha_{Z2}=K_2\alpha_{Z1}$, where $K_2$ is the correction coefficient and $K_2$=1~1.2, that is, $\alpha_{Z2}$=33°. $K_2$ is taken as 1.15.

The blade angle for outlet side 8 at the suction face 10 of the optimized blade 2 $\alpha_{b2}=K_3\alpha_{b1}$, where $K_3$ is the correction coefficient and $K_3$=0.8~1, that is, $\alpha_{b2}$=26. $K_3$ is taken as 0.9.

The thickness of circumferential blades for inlet side on the optimized blade 2 $d_{j2}=K_4d_{j1}$, where $K_4$ is the correction coefficient and $K_4=0.5\sim0.8$, that is, $d_{j2}=3.9$. $K_3$ is taken as 0.6.

The thickness of circumferential blades for outlet on the optimized blade 2 $d_{c2}=K_5d_{c1}$, where $K_5$ is the correction coefficient and $K_5=1.2\sim2$, that is, $d_{c2}=26.3$. $K_5$ is taken as 1.8.

For the optimized blade 2, the number of blades $Z_2=K_1Z_1$, which is calculated and rounded. In this equation, $K_1$ is the correction coefficient and $K_1=0.4\sim0.6$, that is, $Z_2=3$. $K_1$ is taken as 0.5.

The number ($Z_3$) of blades for the medium-length splitter blade 3, the number ($Z_4$) of blades for the short splitter blade 4 and the number ($Z_2$) of blades for the long blade 2 are equal.

The diameter of inlet side on the medium-length splitter blade $$3d_2 = \frac{3d_4 + 2d_1}{3} = 123.5.$$

The diameter of inlet side on the short splitter blade $$4d_3 = \frac{2d_4 + 3d_1}{3} = 161.7,$$

where, $d_4$ represents the outer diameter of the impeller and $d_1$ denotes the diameter of inlet side on the optimized long blade 2.

The dip angle ($\beta_2$) of inlet side on the medium-length splitter blade 3, the dip angle ($\beta_3$) of inlet side on the short splitter blade 4 and the dip angle ($\beta_1$) of inlet side on the optimized long blade 2 shall conform to the following relationship, which is $\beta_1=\beta_2=\beta_3=130°$.

The circumferential spacing angle ($\theta_3$) of the optimized blade 2 and the number ($Z_2$) of impeller blades shall conform to the following relationship, which is $$\theta_3 = \frac{360}{Z_2} = 120.$$

The circumferential spacing angle ($\theta_2$) of the medium-length splitter blade 3 and that ($\theta_1$) of the short splitter blade 4 shall conform to the following relationships.

$$\theta_1 = \frac{60(\cos\alpha_{z2} + \cos\alpha_{b2})}{Z_2\cos\alpha_{z2}} = 41.6°;$$

$$\theta_2 = \frac{120(\cos\alpha_{z2} + \cos\alpha_{b2})}{Z_2\cos\alpha_{z2}} = 83.2°;$$

where $Z_2$ denotes the number of optimized long blades. $\alpha_{Z2}$ represents the blade angle of outlet side 8 on the pressure surface 9 of the optimized long blade 2, and $\alpha_{b2}$ indicates the blade angle of outlet side 8 on the suction surface 10 of the optimized long blade 2.

The hub A of inlet on the impeller is chamfered. The fillet radius ($R_1$), the inner diameter (d) of hub and the diameter ($d_5$) of hub for the inlet side on the impeller shall conform to the relationship $R_1=K_6(d_5-d)$, where $K_6$ is the correction coefficient and $K_6=0.05\sim0.25$, that is, $R_1=K_6(d_5-d)=1.2$. $K_6$ is taken as 0.1.

The front end B of outlet on the blades is chamfered. Its fillet radius ($R_2$) and the thickness ($d_{c2}$) of circumferential blades on the outlet side of blades shall conform to the relationship $R_2=K_7d_{c2}$, where $K_7$ is the correction coefficient and $K_7=0.2\sim0.4$, that is, $R_2=K_7d_{c2}=7.9$. $K_7$ is taken as 0.3.

Figure 4:
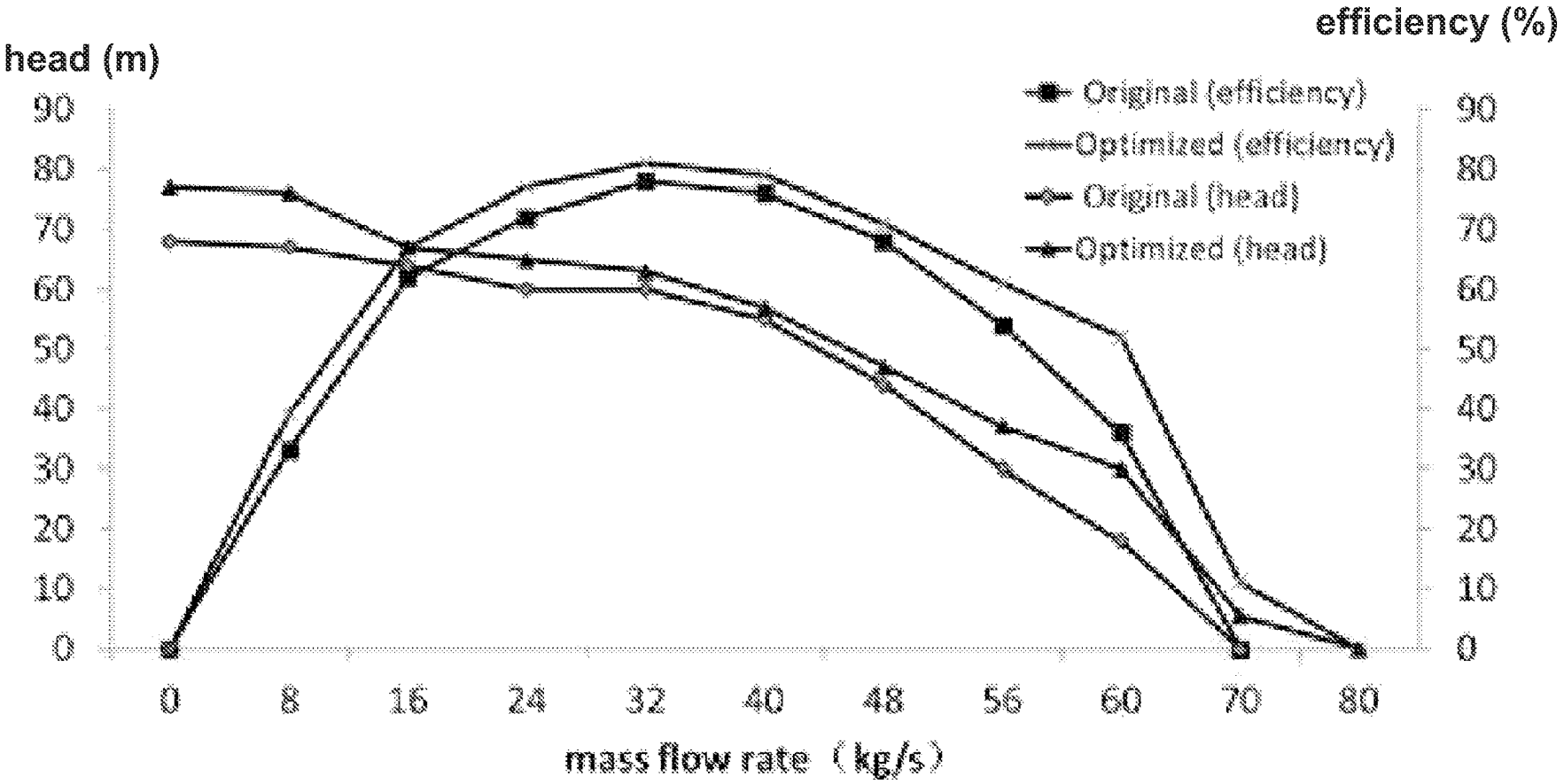
FIG. 4 presents the performance comparison before and after the optimization.

FIG. 4 presents a comparison of pump performance before and after the optimization, from which it can be seen clearly that such an optimization improves pump efficiency and increase the lift range to some degree, especially that of the dead point. The maximum lift is increased by 13.2%, the maximum flow is improved by 14.3%, and the maximum efficiency is enhanced by 3.8%, which indicates that the hydraulic performance of the semi-open centrifugal pump is genuinely optimized.

The semi-open centrifugal pump impeller consists of the optimized long blade 2 along with the medium-length splitter blade 3 and the short splitter blade 4. The medium length splitter blade 3 and short splitter blade 4 are arranged with varying circumferential distances in between any two optimized long blades as mentioned above. The medium length splitter blade 3 and short splitter blade 4 as mentioned above have the same outlet position, profile and thickness as the optimized long blade 2. The medium length splitter blade 3 and short splitter blade 4 as mentioned above have different inlet position to the optimized long blades. The above-mentioned optimized long blade 2 as well as the medium length splitter blade 3 and short splitter blade 4 are arranged in circumferential sequence along the direction of impeller spinning.

Despite the above-mentioned real case being preferentially selected for the invention, it is not restricted to that. As long as there is no deviation from the essence of the invention, the technical personnel in this field are capable of making any notable improvement, substitution or modification, all of which fall within the category of protection by the invention.

According to the design described in detail above, the number of long blades is changed and the medium and short length blades are added to improve in-channel circulation and reduce the loss of front cover leak, which is effective in enhancing the lift range of the dead point for pump and its efficiency and reducing cavitation.

According to this optimization design, the hub of inlet side on the impeller is optimized by chamfering. When there is fluid passing through the hub of inlet side on the impeller, the separation of boundary layers occurs and vortex is induced. When the pressure is low, inlet cavitation could occur, which results in loss and channel blockage. To address this problem, our invention proposes chamfering of the hub of inlet side on the impeller to form a transition surface, which could reduce the loss when fluid passes through. Meanwhile, cavitation can be reduced significantly, which is conducive to reducing impact loss at the inlet and channel resistance.

According to the design described above, the thickness of blades on the inlet side and outlet side of the impeller is optimized, that is, the inlet blades are reduced in thickness, the outlet blades are increased in thickness, and the pressure surface of impeller outlet is chamfered. In doing so, the flow area is effectively increase at the inlet side, the pressure difference is reduced at the suction surface of the outlet blades, as well as vortex and cavitation are reduced for the impeller outlet.

According to the design adopted in the invention, a comparison is performed of the semi-open centrifugal pump before and after optimization. It is clearly seen that such an optimization improves pump efficiency and increases the lift range to some extent, especially that of the dead point. The maximum lift is increased by 13.2%, the maximum flow is improved by 14.3%, and the maximum efficiency is enhanced by 3.8%, which indicates that the hydraulic performance of the semi-open centrifugal pump is genuinely optimized.

Finally, it should be noted, the above embodiments are merely illustrative of the technical solution of the present invention rather than limiting. Although the present invention is illustrated in detail with reference to the preferred embodiments, it should be understood by those of ordinary skill in the art, modifications or equivalent replacements can be made to the technical solution of the present invention without departing from the spirit and scope of the technical solution of the present invention, which also fall within the scope of claims of the present invention.

Having thus described the invention, what is claimed is:

1. A method of optimizing a design of a semi-open centrifugal pump impeller rotatable in a direction of rotation and having a predetermined number of long blades fitted on the impeller, each long blade having a first radial length with a first blade angle for an outlet side of a pressure surface of the long blades and a second blade angle for an outlet side on a suction surface of the long blades; a circumferential portion of said long blades on an inlet side of the long blades having a first thickness dimension; a circumferential portion of said long blades on an outlet side of the long blades having a second thickness dimension, comprising the steps of:

reducing the predetermined number of long blades to a lower number of optimized long blades to optimize performance of said pump impeller;

adding medium length and short length splitter blades having varying circumferential positioning between adjacent optimized long blades, each said medium length splitter blades having a second radial length shorter than said first radial length of said long blade, each said short length splitter blades having a third radial length shorter than said second radial length of said medium length splitter blades, each of said medium length and short length splitter blades having identical outlet positions, profile and thickness dimension as the optimized long blades, the medium length and short length splitter blades having different inlet positions than the optimized long blades; and arranging said lower optimized number of long blades, said medium length splitter blades and said short length splitter blades in a circumferential sequence along a direction of rotation of said impeller, with one of said medium length splitter blades and one of said short length splitter blades being positioned between sequential said optimized long blades.

2. The method of claim 1 wherein the blade angle for the outlet side on the pressure surface of the long blades before the optimization is set as $\alpha_{Z1}$ the blade angle for the outlet side on the suction surface of the long blades before the optimization is set as $\alpha_{b1}$, a thickness of the circumferential portion of said long blades on the inlet side of the long blades before the optimization is set as $d_{j1}$, a thickness of the circumferential portion of said long blades on the outlet of the long blades before the optimization is set as $d_{c1}$.

3. The method of claim 2, wherein, the above-mentioned optimized long blades as well as the medium and short length splitter blades have identical epiphyseal lines as the long blades before optimization.

4. The method of claim 1, wherein the blade angle for the outlet side on a front end of each of said optimized long blades is defined as $\alpha_{Z2}=K_2\alpha_{Z1}$, where a represents the blade angle of the long blades before optimization and $K_2$ represents the correction coefficient and $K_2=1\sim1.2$; the blade angle for the outlet side on the suction surface of optimized long blades is defined as $\alpha_{b2}=K_3\alpha_{b1}$, where $K_3$ represents the correction coefficient and $K_3=0.8\sim1$.

5. The method of claim 1, wherein, the thickness of the circumferential portion of said long blades on the inlet side of optimized long blades is $d_{j2}=K_4d_{j1}$, where $d_{j1}$ represents a thickness of said long blades at respective blade inlets and $K_4$ represents the correction coefficient and $K_4=0.5\sim0.8$; a thickness of the circumferential portion of said long blades on the inlet side of optimized long blades (2) is, $d_{c2}=K_5d_{c1}$ where $d_{c1}$ represents the thickness of said long blades before optimization and $K_5$ represents the correction coefficient and $K_5=1.2\sim2$.

6. The method of claim 1, wherein, the number of optimized long blades $Z_2=K_1Z_1$, is calculated and then rounded, where $Z_1$ represents the number of long blades before optimization and $K_1$ denotes the correction coefficient and $K_1=0.4\sim0.6$; the number of medium length splitter blades is $Z_3$, the number of short splitter blades is $Z_4$ and identical to that of the long blades, $Z_2$; the diameter of inlet side on the medium length splitter blades (3) is $$d_2 = \frac{3d_4 + 2d_1}{3},$$

a diameter of an inlet side on the short splitter blades (4) is $$d_3 = \frac{2d_4 + 3d_1}{3},$$

where $d_4$ represents an outer diameter of the impeller; $d_1$ denotes a diameter of an inlet side on the optimized long blades; a dip angle ($\beta_2$) of the inlet side on the medium-length splitter blades, a dip angle ($\beta_3$) of inlet side on the short splitter blades and a dip angle ($\beta_1$) of inlet side on the optimized long blades shall conform to the following relationship, which is $\beta_1=\beta_2=\beta_3$.

7. The method of claim 1, wherein, a circumferential spacing angle ($\theta_2$) of the medium-length splitter blades and a circumferential spacing angle ($\theta_1$) of the short splitter blades shall conform to the following relationships:

$$\theta_1 = \frac{60(\cos\alpha_{z2} + \cos\alpha_{b2})}{Z_2\cos\alpha_{z2}};$$

$$\theta_2 = \frac{120(\cos\alpha_{z2} + \cos\alpha_{b2})}{Z_2\cos\alpha_{z2}};$$

where $Z_2$ denotes the number of optimized long blades;

$\alpha_{Z2}$ represents the first blade angle of outlet side on the pressure surface of the optimized long blades; $\alpha_{b2}$ indicates the blade angle of outlet side on the suction surface of the optimized long blades.

8. The method of claim 1, wherein, a hub of an inlet side on the impeller is chamfered, a fillet radius ($R_1$) at an inner diameter (d) of hub and a diameter ($d_5$) of hub for an inlet side on the impeller shall conform to the relationship: $R_1=K_6(d_5-d)$, where $K_6$ is the correction coefficient and $K_6=0.05\sim0.25$.

9. The method of claim 1, wherein, the pressure surface (9) of outlet side (8) on the blades is chamfered, its fillet radius ($R_2$) and a thickness ($d_{c2}$) of the circumferential portion of said long blades on the outlet side (8) of blades shall conform to the relationship:

$R_2=K_7d_{c2}$, where $d_{c2}$ represents the thickness of the circumferential portion of said long blades and $K_7$ is the correction coefficient and $K_7=0.2\sim0.4$.

10. The method of claim 1, wherein the medium and short length splitter blades are arranged with varying circumferential distances in between any two optimized long blades; the medium and short length splitter blades having the same outlet position, profile and thickness as the optimized long blades, the medium and short length splitter blades having different inlet position to the optimized long blades; the above-mentioned optimized long blades as well as the short and medium length splitter blades being arranged in circumferential sequence along the direction of rotation of said impeller.

11. An optimization design of the semi-open centrifugal pump impeller according to claim 1, wherein, the above-mentioned optimized long blades as well as the medium and short length splitter blades have identical epiphyseal line as the long blades before optimization.

12. An optimization design of the semi-open centrifugal pump impeller according to claim 1, wherein, the blade angle for the outlet side on the front end of the optimized long blades is $\alpha_{Z2}=K_2\alpha_{Z1}$, where $\alpha_{Z1}$ represents the blade angle for the outlet side on the front end of the long blades before optimization and $K_2$ represents the correction coefficient and $K_2=1\sim1.2$; the blade angle for the outlet side on the suction surface of the optimized long blades being $\alpha_{b2}=K_3\alpha_{b1}$, where $\alpha_{b1}$ represents the blade angle for the outlet side of the long blades on the suction surface before optimization and $K_3$ represents the correction coefficient and $K_3=0.8\sim1$.

13. An optimization design of the semi-open centrifugal pump impeller according to claim 1, wherein, the thickness of the circumferential portion of said long blades on an inlet side of the optimized long blades (2) is $d_{j2}=K_4d_{j1}$, where $d_{j1}$ represents the thickness of the circumferential portion of said long blades on the inlet side before optimization and $K_4$ represents the correction coefficient and $K_4=0.5\sim0.8$; a thickness of the circumferential portion of said long blades on the inlet side of the optimized long blades (2) is $d_{c2}=K_5d_{c1}$, where $d_{c1}$ represents the thickness of the circumferential portion of said long blades before optimization and $K_5$ represents the correction coefficient and $K_5=1.2\sim2$.

14. An optimization design of the semi-open centrifugal pump impeller according to claim 1, wherein, the number of optimized long blades $Z_2=K_1Z_1$, which is calculated and then rounded, where $Z_1$ represents the number of long blades before optimization and $K_1$ denotes the correction coefficient and $K_1=0.4\sim0.6$; the number of medium length splitter blades being $Z_3$, the number of short splitter blades being $Z_4$ and identical to that of long blades, $Z_2$; a diameter of an inlet side on the medium length splitter blades is $$d_2 = \frac{3d_4 + 2d_1}{3},$$

a diameter of an inlet side on the short splitter blades being $$d_3 = \frac{2d_4 + 3d_1}{3},$$

where $d_4$ represents a outer diameter of the impeller; $d_1$ denotes a diameter of an inlet side on the optimized long blades; a dip angle ($\beta_2$) of an inlet side on the medium-length splitter blades, a dip angle ($\beta_3$) of an inlet side on the short splitter blades and a dip angle ($\beta_1$) of an inlet side on the optimized long blades shall conform to the following relationship, which is $\beta_1=\beta_2=\beta_3$.

15. An optimization design of the semi-open centrifugal pump impeller according to claim 1, wherein, a circumferential spacing angle ($\theta_3$) of the medium-length splitter blades and that ($\theta_1$) of the short splitter blades shall conform to the following relationships:

$$\theta_1 = \frac{60(\cos\alpha_{Z2} + \cos\alpha_{b2})}{Z_2\cos\alpha_{Z2}}; \text{ and}$$

$$\theta_2 = \frac{120(\cos\alpha_{Z2} + \cos\alpha_{b2})}{Z_2\cos\alpha_{Z2}};$$

where $Z_2$ denotes the number of optimized long blades; $\alpha_{Z2}$ represents a blade angle of an outlet side on a pressure surface of the optimized long blades; $\alpha_{b2}$ indicates a blade angle of an outlet side on the suction surface of the optimized long blades.

16. An optimization design of the semi-open centrifugal pump impeller according to claim 1, wherein, a hub of an inlet side on the impeller is chamfered, a fillet radius ($R_1$), an inner diameter (d) of hub and a diameter ($d_5$) of a hub for an inlet side on the impeller shall conform to the relationship: $R_1=K_6(d_5-d)$, where $K_6$ is the correction coefficient and $K_6=0.05\sim0.25$.

17. An optimization design of the semi-open centrifugal pump impeller according to claim 1, wherein, a pressure surface of an outlet side on the long blades is chamfered, its fillet radius ($R_2$) and a thickness ($d_{c2}$) of a circumferential portion of said long blades on an outlet side (8) of the long blades shall conform to the relationship: $R_2=K_7d_{c2}$, where $K_7$ is the correction coefficient and $K_7=0.2\sim0.4$.

18. An optimization design of the semi-open centrifugal pump impeller according to claim 1, wherein the medium and short length splitter blades are arranged with varying circumferential distances in between any two optimized long blades; the medium and short length splitter blades have the same outlet position, profile and thickness as the optimized long blades, the medium and short length splitter blades as mentioned above have different inlet position to the optimized long blades; the above-mentioned optimized long blades as well as the short and medium length splitter blades are arranged in circumferential sequence along the direction of the spinning of the impeller.

19. An optimization design of a semi-open centrifugal pump impeller having a number of long blades fitted on the impeller before optimization, each said long blade having a first radial length, a blade angle for an outlet side on a pressure surface of the long blades before optimization is set as $\alpha_{Z1}$, a blade angle for an outlet side on a suction surface of the long blades before the optimization is set as $\alpha_{b1}$, a thickness dimension of a circumferential portion of said long blades on inlet side of the long blades before the optimization is set as $d_{j1}$, a thickness dimension of a circumferential portion of said long blades on the outlet of the long blades before the optimization is set as $d_{c1}$, comprising the steps of:

the number of long blades after optimization is lower than before optimization; medium length and short length splitter blades are added and arranged with varying circumferential distances in between any two optimized long blades; the medium length splitter blades having a second radial length shorter than said first radial length and said short length splitter blades having a third radial length shorter than said second radial length, the medium and short length splitter blades having the same outlet position, profile and thickness as the optimized long blades, and the medium and short length splitter blades having different inlet position to the optimized long blades; the above-mentioned optimized long blades as well as the short and medium length splitter blades are arranged in circumferential sequence along a direction of rotation of said impeller.

* * * * *